United States Patent [19]

Kim et al.

[11] 4,433,841

[45] Feb. 28, 1984

[54] MULTIPLE CHOICE TOSSING GAME

[76] Inventors: Bill S. Kim, 1238 S. Orange Dr., Los Angeles, Calif. 90019; Jung J. Ban, 161 S. Occidental Blvd., #1, Los Angeles, Calif. 90057

[21] Appl. No.: 377,004

[22] Filed: May 11, 1982

[51] Int. Cl.[3] ..... A63B 67/06

[52] U.S. Cl. ..... 273/338

[58] Field of Search ..... 273/336, 338, 339

[56] References Cited

U.S. PATENT DOCUMENTS

| | | | |
|---|---|---|---|
| 158,991 | 1/1875 | Smith | 273/338 |
| 593,343 | 11/1897 | Whitney | 273/400 |
| 626,328 | 6/1899 | Kroscher et al. | 273/338 |
| 979,109 | 12/1910 | Underhill | 273/400 |
| 1,279,654 | 9/1918 | Charlesworth | 273/399 |
| 2,432,824 | 12/1947 | Shetler | 273/336 X |
| 3,787,053 | 1/1974 | Breslow | 273/399 X |

*Primary Examiner*—William H. Grieb

*Attorney, Agent, or Firm*—Erik Arnhem

[57] ABSTRACT

Multiple choice tossing game, comprising a bowl shaped base having numbered pits; pins, removably pressure fitted within the pits and rings for tossing over the pine; when the pins are removed, the pits may be utilized for receiving dice or balls.

1 Claim, 2 Drawing Figures

MULTIPLE CHOICE TOSSING GAME

BACKGROUND OF THE INVENTION (1) Field of the Invention

The invention relates to a tossing game that may be used by one or several participants, indoors as well as outdoors. Conventional games of this kind may only be played in one general manner and do not have built-in potentials for related but different types of games. In other words, conventional games do not offer variety and, perhaps the most important reason for the diminishing popularity of certain games, e.g., yo-yo, is that they basically can only do "one thing".

The game, according to the invention, thus offers variety and one of the interchangeable features of same may lend itself better, in some instances, to adults than children, (and vice versa), for use outside than indoors, etc.

As will be explained in greater detail in the following, when removing certain parts of the game, there is created novel means for playing the tossing game.

(2) Prior Art

Applicants are not aware of any prior art specifically relating to their present invention.

SUMMARY OF THE INVENTION

In addition to what was stated under (d) above, our invention concerns a base for a tossing game, having a number of pits, into which bowling-type pins may be removeably pressure fitted. Rings are tossed from a proper distance for settling around the pins. Each pin is marked with a different number and the scores, e.g., are added up according to the pins being ringed. The pins may also be removed, exposing the pits, likewise marked by different numbers and a new type game can be started. Participants will now use balls which are thrown from a distance into the pits. Again, the scores achieved by the participants may simply be added up and the highest scorer wins. A die (or set of dice) is also provided as a substitute for the balls, which may be tossed into the pits. The number coming up on the dice may be added to (or multiplied with) the marked number in the pit in tallying the scores of the game.

There is provided slanting terraced inlets to the pits to assure that the objects thrown into the pits are not bouncing back, but remain in the pits. In throwing rings over the pins, or dice or balls into the pits, the playing participant will try to ring or hit the pin or pits, respectively carrying the highest score, but of course, it is possible that in doing so one may ring or hit one marked with a smaller number, or not ring or hit the target at all.

DESCRIPTION OF THE INVENTION

Figure 1:
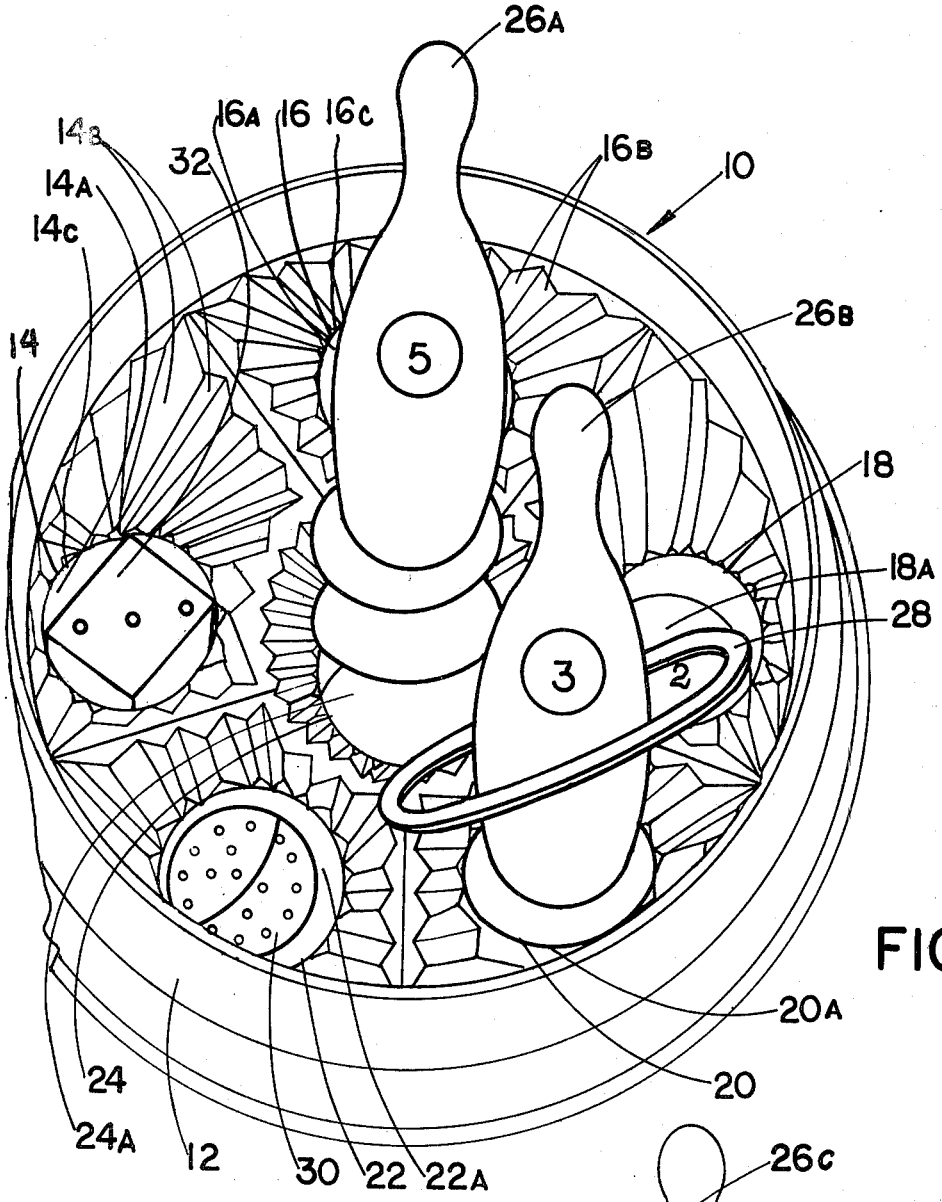
FIG. 1 is a perspective view of the base of the game, with pins partially inserted.

In the drawings like reference characters designate similar parts in the several views of the drawings.

In FIG. 1, numeral 10 indicates the device, according to the invention, including the components (partially) required for the game. An open bowl or base 12 thereof is circular in shape, preferably made of sturdy plastic material and divided into six pits 14, 16, 18, 20, 22 and

24; the latter is situated in the center of the base 12, while the other pits radiate out from the center, within five circular segments (FIG. 1).

Each pit is cylindrically shaped, having a flat bottom 14*a*, 16*a*, etc. marked with a score number, 1, 2, 3, 4, 5 and 6, respectively (not shown except for numeral 2 in pit 18).

The inlet to each pit, 14, 16 etc., is formed by a multiplicity of mutually offset narrow sections such as 14*b*, etc. radiating slanting upwardly from the edge 14*c*, 16*c*, etc. of pits 14, 16, etc., towards the interior upper edge of base 12, terminating in and forming ridges with slanting sections from adjacent pits.

The game 10 is provided with six bowling-type pins 26, of which 26*a*, 26*b*, 26*c*, preferably made hollow and of light plastic and marked respectively with a score number (e.g., 3, 5). Pins 26 may be pressure fitted into (and easily removed from) the pits 14, 16, etc., and the game then constitutes a conventional tossing game with stationary pins, over which ring 28 or a variation thereof, 28*a* is thrown selectively by participants to the game in order to compete for the highest score. Ring 28*a* consists of two rings intersecting one another perpendicularly.

For the purpose of variety or preference, one may remove pins 26 from pits 14, 16, etc., and now use one of several balls 30, e.g., a small golf ball with a multitude of minute depressions, which participants to the game may throw or attempt to throw from a certain distance into open pits 14, 16, etc., again competing to obtain the hightest score.

Instead of the ball 30, one may also use a hard or hollow dice 32 made of e.g., rubber, which likewise may be used by the participants to record the number of dots coming up on the dice in combination with the scores number marked on bottom 14*a*, 16*a*, etc. of pits 14, 16, etc.

Figure 2:
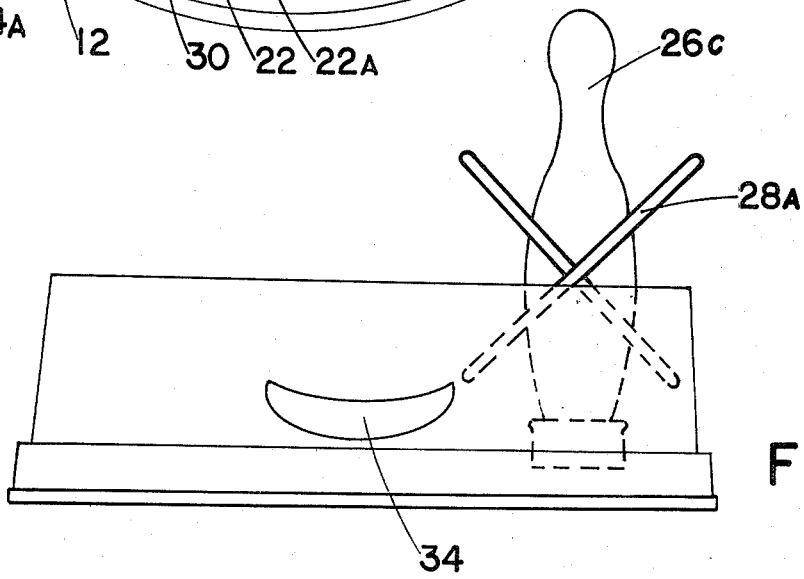
FIG. 2 is an elevational view of the base with a ringed pin.

Base 12 is provided, at a convenient location, with two oppositely located recesses or openings 34, of which one is shown in FIG. 2, for easy handling or lifting of the game.

Participants to the game may play, according to any scoring system. However, the following is a suggested way of playing the games:

1. When playing with 6 rings and 6 pins (inserted in base):

Each participant uses five rings, tossing them one by one and tallying the number (1, 2, 3, 4, 5, 6) marked on each ringed pin. Example: If two rings are on pin marked 3, the score is $2\times3=6$. Maximum points attainable: 25.

2. When playing with balls (the pins are being removed from the base).

The participant tosses six balls, one by one, into the open base and score the number(s) marked in the pit of the base, in which the ball(s) fell. Example: If three balls went into the pit marked 5, the score would be $3\times5=15$. Maximum points attainable: 25.

3. When using dice:

The participant tosses six dice one by one into the open base, and scores the number coming up on the dice plus the number marked in the pit of the base. Example: If two dice landed in pit marked 3 and the numbers on the dice was 4 and 5, the score would be $2\times3+4+5=15$. Maximum score attainable: 55.

One may also add bonus points (when playing with rings or balls); if, for example, two or more rings or balls score on one pin or in one hole, respectively, bonus points could be added to the basic scores, by allowing one more point for each pin or ball. Example: If two rings are thrown over one pin marked 3, the score would then become $2\times3+2=8$, and so on.

The game may be played by one or by a team; one game or a combination of two or three games could be played with a maximum score of 105 attainable.

While the foregoing has illustrated and described what is now contemplated to be the best mode of carrying out the invention, the description is, of course, subject to modification without departing from the spirit and scope of the invention. Therefore, it is not desired to restrict the invention to the particular constructions illustrated and described, but to cover all modification that may fall within the scope of the appended claims.

We claim:

1. In a multiple choice tossing game, playable with tossing rings and other tossing means by one as well as several participants, comprising:

(a) a bowl shaped base, having an upper circular edge and therewithin a plurality of numbered pits including a center pit around which the other pits are circularly disposed, said pits, respectively are flat bottomed and terminate in an upper circular edge, from which a plurality of narrow mutually offset sections radiate slanting upwardly towards the said upper edge of the bowl, so as to terminate in and form ridges with slanting sections from adjacent pits, (b) A plurality of numbered bowling pins, for receiving the tossing rings, capable of being pressure fitted, respectively within the pits, said pins are removable, so that the pits of the base may be utilized for receiving other tossing means.

* * * * *